US006353284B1

(12) United States Patent
Elfner et al.

(10) Patent No.: US 6,353,284 B1
(45) Date of Patent: Mar. 5, 2002

(54) GLASS FUNNEL WITH A NEARLY RECTANGULAR CROSS-SECTIONED PARABOLIC REGION ESPECIALLY FOR A TELEVISION TUBE

(75) Inventors: Peter Elfner, Nieder-Olm; Anne Schott, Trebur; Stefan Hergott, Wiesbaden, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/569,288

(22) Filed: May 12, 2000

(30) Foreign Application Priority Data

May 14, 1999 (DE) ..... 199 22 225

(51) Int. Cl.[7] ..... H01J 31/00
(52) U.S. Cl. ..... 313/477 R
(58) Field of Search ..... 313/402, 407, 313/408, 461, 477 R, 440, 403, 434

(56) References Cited

U.S. PATENT DOCUMENTS 3,731,129 A * 5/1973 Tsuneta et al. ..... 313/402
5,801,481 A * 9/1998 Yokota ..... 313/440
6,255,766 B1 * 7/2001 Park et al. ..... 313/408

FOREIGN PATENT DOCUMENTS

EP 0 813 224 A2 12/1997
WO 98/07174 2/1998

* cited by examiner

*Primary Examiner*—Michael H. Day
*Assistant Examiner*—Joseph Williams
(74) *Attorney, Agent, or Firm*—Michael J. Striker

(57) ABSTRACT

The glass funnel for a cathode ray tube includes a cylindrical funnel neck (2); a funnel body (4) having successive transverse cross-sections that change over from a substantially circular shape to a substantially rectangular shape with cross-sectional areas growing continuously in a direction moving away from the funnel neck and a parabolic region (3) arranged between the funnel neck and the funnel body and having respective connecting sections to the funnel neck and the funnel body having corresponding substantially circular cross-sections. The parabolic region (3) has at least one part with a substantially rectangular cross-section and the at least one part is located between the respective connecting sections to the funnel neck and the funnel body. When a cathode ray tube is made from the glass funnel the electron gun is located in the funnel neck and the deflecting coil is arranged around to the parabolic section so that it is substantially closer than in the prior art cathode ray tube. The glass funnel described herein thus provides energy savings and a more precise electron beam guidance than the corresponding prior art glass funnel, when it is incorporated in a cathode ray tube.

4 Claims, 2 Drawing Sheets

FIG. 1
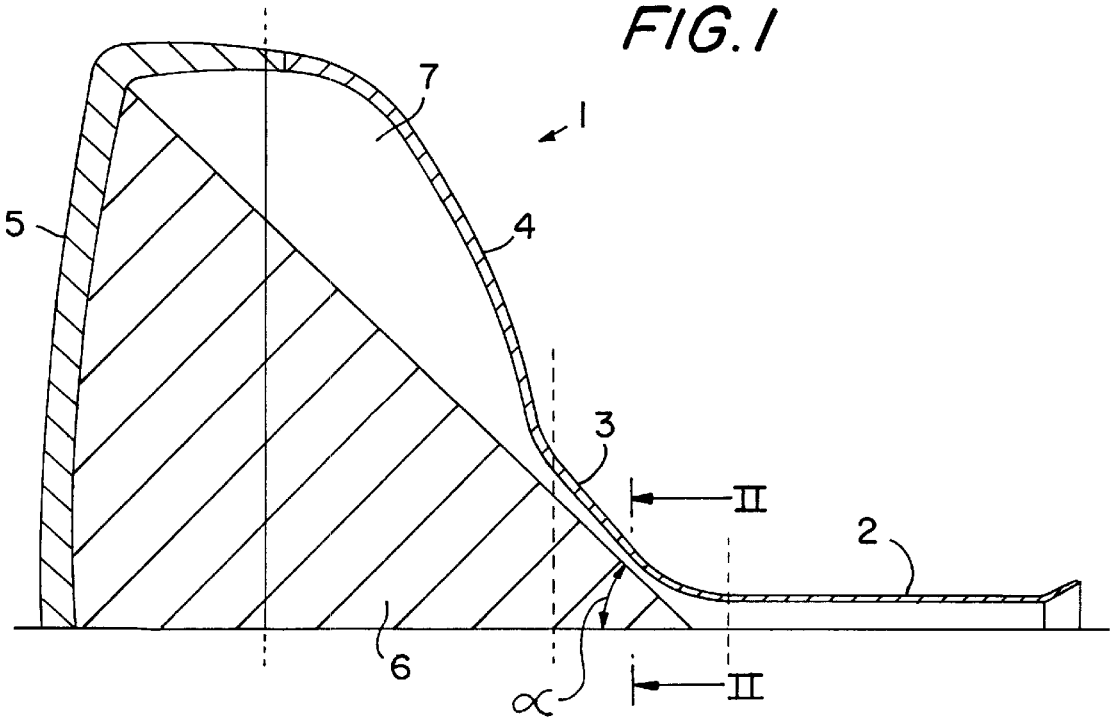
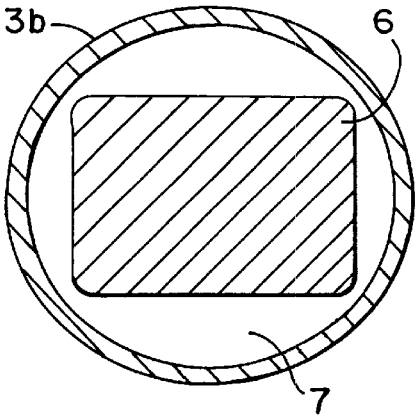
FIG. 3
PRIOR ART
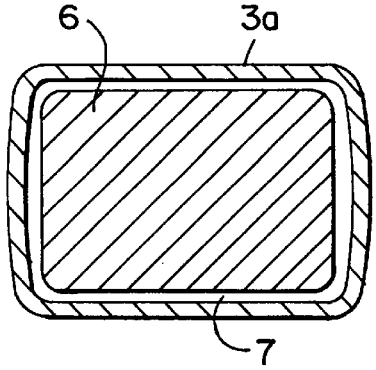
FIG. 2

GLASS FUNNEL WITH A NEARLY RECTANGULAR CROSS-SECTIONED PARABOLIC REGION ESPECIALLY FOR A TELEVISION TUBE

BACKGROUND OF THE INVENTION

1. Field of the Invention

The present invention relates to a glass funnel for use in a cathode ray tube, especially a television tube. The glass funnel according to the invention relates to a glass funnel including a funnel neck which is cylindrical; a funnel body whose transverse cross-sections change over from a substantially circular shape to a substantially rectangular shape and whose cross-sectional areas grow continuously in a direction moving away from the funnel neck and a parabolic region arranged between the funnel neck and the funnel body and wherein the respective connecting sections of the parabolic region to the funnel neck and the funnel body have corresponding substantially circular cross-sections.

2. Prior Art

This sort of glass funnel is described in WO 98/07174 A2.

Cathode ray tubes are used as an important part of a television set. They include a glass funnel, which forms the evacuated space of the tube together with the television or display screen.

The glass funnel itself has three parts: a neck, which contains the electron beam gun and is cylindrical; a parabolic region, around which a deflection coil for guiding the electron beam is arranged and which has circular transverse cross-sections increasing in area in a direction moving away from the neck and a funnel body whose cross-sectional areas continuously increase and change over from a circular to a substantially rectangular shape, until the cross-sectional area of the television screen is reached. The term "substantially or approximately rectangular" here and in the following means rectangular, but with rounded corners. Also the area of the television screen on which the electron beam acts or strikes is substantially rectangular as well as the television screen itself. This means that a substantial part of the area in the region of the glass funnel having a substantially circular cross-section is unused for passage of the electron beam. Since the deflection coil for guiding the electron beam is arranged outside of the funnel, a greater portion of the energy (about 25%), which is supplied to the coil, must be used for overcoming the distance to the electronic beam by the magnetic field.

EP 0 813 224 A2 describes a glass funnel whose cross-section is substantially circular only in the funnel neck region, but already substantially rectangular at the parabolic region. Because of this feature of their glass funnel the unused portion is reduced and the deflection coil can be mounted closer to the electron beam. This leads to a considerable energy saving. The disadvantage of the approximately rectangular parabolic region suggested in that reference is that there is a significant implosion danger for the cathode ray tube formed with this parabolic region. Very narrow specifications or tolerances are connected with the geometry of the glass funnel or in the type and manner in which the cross-sectional area increases and in the manner in which the parabolic region begins. Sufficient implosion safety is guaranteed only if these specifications are followed closely. From the production engineering point of view there is also the danger that the entire manufacturing process must be rearranged or changed because of the introduction of this entire newly shaped parallel region, since then the glass funnel shape must be greatly changed from its standard form.

SUMMARY OF THE INVENTION

It is an object of the present invention to provide a glass funnel of the above-described kind, especially for a cathode ray tube, particularly a television tube, whereby energy is saved in operation of the resulting cathode ray tube formed from the glass funnel and implosions of the cathode ray tube are reliably prevented as much as possible.

This object and others which will be made more apparent hereinafter are attained in a glass funnel including a funnel neck which is cylindrical; a funnel body whose transverse cross-sections change over from a substantially circular shape to a substantially rectangular shape and whose cross-sectional areas grow continuously in a direction moving away from the funnel neck and a parabolic region arranged between the funnel neck and the funnel body and including respective connecting sections to the funnel neck and the funnel body having corresponding substantially circular cross-sections.

According to the invention the parabolic region has at least one part or portion with a substantially rectangular cross-section and the at least one part or portion is located between the respective connecting sections to the funnel neck and the funnel body.

The glass outer surface of the glass funnel on the smaller and larger axes are brought closer to the funnel central axis by means of a substantially rectangular cross-section in a center or middle portion of the parabolic region. The length of this center portion with the substantially rectangular cross-section varies in the centimeter range. Since the electron beam deflection unit sits directly on the glass outer surface, the deflection unit will be brought closer to the electron beam, which extends within the funnel. The magnetic field, which must be built up by the deflection unit to guide the electron beam, must thus pass over a smaller gap or spacing and can be correspondingly much weaker. Because of this aspect of the invention electrical energy is saved.

The larger the spacing to the source of the magnetic field, the greater the spacing of the field lines. Since the magnetic field is now closer to the electron beam, the field line density for the cathode ray tube made with the glass funnel according to the invention relative to the field line density with the standard prior art parabolic region is thus increased and the electron beam can be guided more precisely.

The glass funnel according to the invention may be embodied both in 4:3 format and also 16:9 format, which are the currently recognized screen formats. The energy saving effect of the invention is better, the greater the deflection angle is, which has especially proven to be correct in the cathode ray tubes in the 16:9 screen format. The size of this effect is especially large for deflection angles of 120° and larger.

Because the funnel form for the entire glass funnel is changed only in a small portion in the center of the parabolic region relative to a conventional prior art glass funnel, the implosion safety is only made slightly poorer. It has been shown that the stresses developed in the glass increase chiefly in the transition region between the funnel neck and the parabolic region. However this change is only on the order of a percentage, or in the percentage range. No additional features for increasing implosion safety are necessary.

In manufacturing and further processing with the glass funnel according to the invention only regions must be changed which effect the shape of the parabolic region. The additional handling of the glass funnel, as e.g. transport or surface processing, can remain unchanged.

The side ratio of the substantially rectangular cross-section of the parabolic region corresponds to the side ratio of the substantially rectangular cross-section of the funnel body at its opposite end from the funnel neck. On this end the funnel body has the side ratio of the display or television screen. Since the electron beam also covers an area with this same side ratio, the deflection coil can thus be applied or mounted so that it is arranged as close to the electron beam as possible from all sides, when the parabolic region has this same side ratio in the portion with the rectangular cross-section.

In a preferred embodiment of the glass funnel the areas of the successive transverse cross-sections through the parabolic region increases continuously. Preferably the diagonals of the cross-sections increase continuously through the enter parabolic region.

BRIEF DESCRIPTION OF THE DRAWING

The objects, features and advantages of the invention will now be illustrated in more detail with the aid of the following description of the preferred embodiments, with reference to the accompanying figures in which:

FIG. 1 is a longitudinal cross-sectional view through a half portion of a glass funnel with a display screen according to the invention;

FIG. 2 is a cross-sectional view through the glass funnel of FIG. 1 taken along the section line II—II;

FIG. 3 is a cross-sectional view through a prior art glass funnel with an approximately circular cross-section similar to FIG. 2.

DETAILED DESCRIPTION OF THE INVENTION

Figure 4:
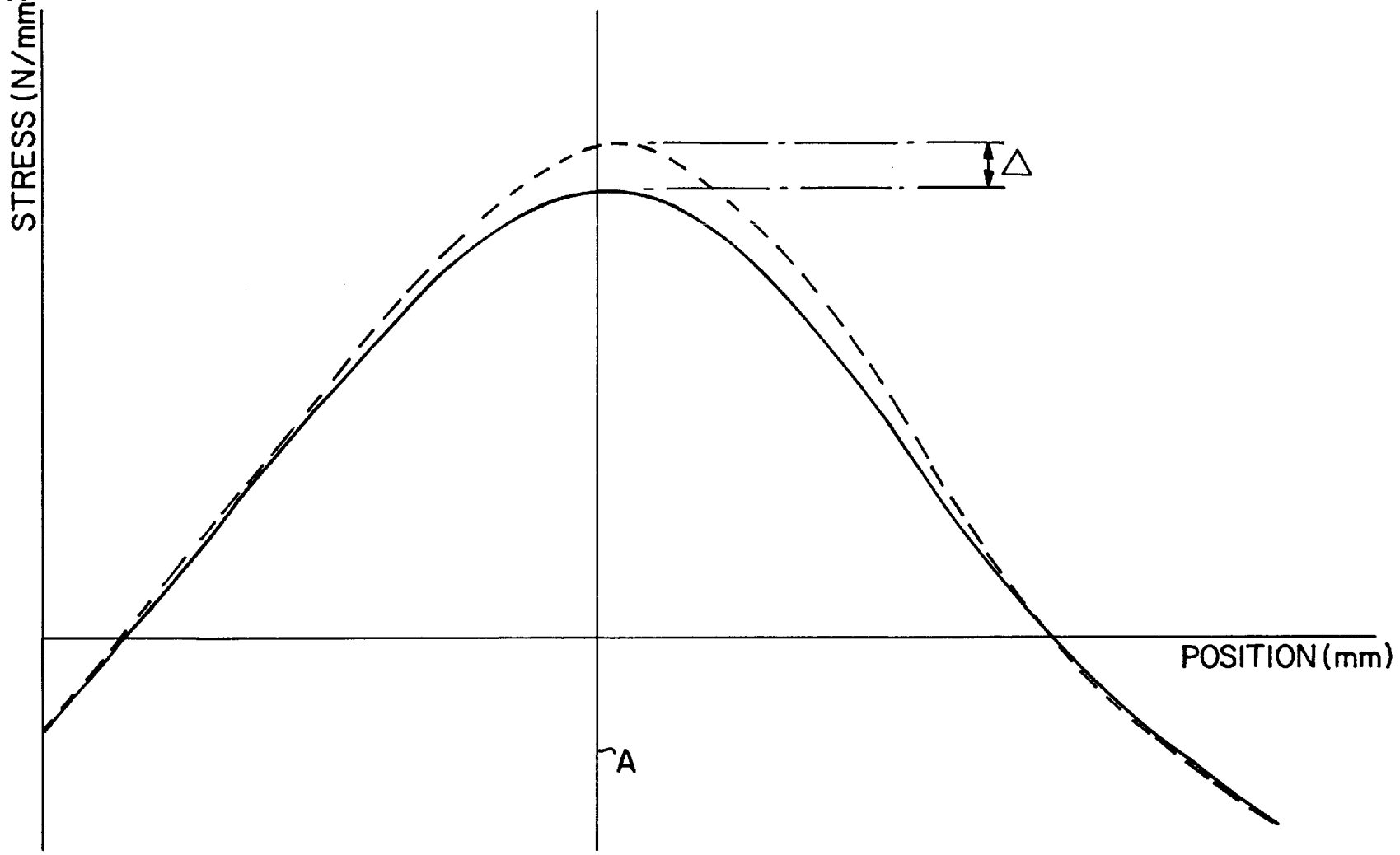
FIG. 4 is a graphical illustration of the local distribution of stresses occurring the glass.

FIG. 1 shows the upper half of a longitudinal cross-section through a glass funnel 1, which is connected with a display screen 5. The glass funnel 1 comprises a cylindrical funnel neck 2, a parabolic region 3 and a funnel body 4. An unshown electron gun is arranged in the funnel neck 2 in the case of a cathode ray tube. An unshown deflection coil is arranged about the parabolic region 3. The funnel neck 2 is cylindrical, the parabolic region 3 has an approximately circular cross-section in respective connection sections to the funnel neck 2 and the funnel body 4. The funnel body 4 has a substantially circular cross-section at the transition to the parabolic region 3. However the area of the transverse cross-sections through the funnel body 4 increases continuously and these cross-sections change over into a substantially rectangular cross-section at the display screen 5. Furthermore in FIG. 1 regions are shown which the electron beam covers with a maximum deflection about the angle $\alpha$ as well as regions which are not covered by the electron beam.

A transverse cross-section through the parabolic region 3 taken along the section line II—II is shown in FIG. 2. This shows that the portion 7 of the cross-section which is not covered by the electron beam in a portion 3*a* of the parabolic region with a substantially rectangular cross-section is significantly smaller than in the corresponding portion in the prior art situation shown in FIG. 3. The surrounding wall of this part 3*a* of the parabolic region 3 with the substantially rectangular cross-section forms a quasi-peripheral edge of the region 6, which is covered by the electron beam. This means that the deflection coil can be arranged in closer proximity to the electron beam than in the prior art device. Also the electron beam can already be deflected with a magnetic beam of lesser energy.

FIG. 3 shows a cross-section through a glass funnel of the prior art with a conventional parabolic region. The region 7 not covered by the electron beam is a much larger portion of the total cross-section in this prior art embodiment. The spacing between the electron beam and the deflection coil is ideally small only at the corners of the region 6 covered by the electron beam.

The positional dependence of the stresses occurring in the glass is shown in the graphical illustration of FIG. 4. The straight line A shows the position at which the funnel neck makes its transition to the parabolic region. The stress values to the left of the straight line A are for the funnel neck but those to the right of the straight line A are for the parabolic region. The solid line corresponds to the standard glass funnel while the dashed line shows the stress values for the glass funnel according to the invention. The stresses are greatest at the transition between the funnel neck and the parabolic region for both funnel types. There the absolute difference between the stresses in both funnels is greatest. Since this difference $\Delta$ is only a few percent or in a percentage range, the implosion safety of the glass funnel according to the invention due to the substantially rectangular cross-sectioned portion of the parabolic region is not significantly reduced in comparison to the prior art glass funnel. The parabolic region with the rectangular cross-sectioned portion with the geometry change according to the invention in other already existing funnel embodiments and with highly used types with large deflection angles of 110°, 120° or the like.

The disclosure in German Patent Application 199 22 225.8-33 of May 14, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a glass funnel for use in a cathode ray tube, especially a television tube, with a substantially rectangular-cross-sectioned parabolic region, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A glass funnel for a cathode ray tube, said glass funnel comprising a cylindrical funnel neck (2);

a funnel body (4) having transverse cross-sections that change over from a substantially circular shape to a substantially rectangular shape with cross-sectional areas growing continuously in a direction moving away from the funnel neck; and a parabolic region (3) arranged between the funnel neck and the funnel body and having respective connecting portions to the funnel neck and the funnel body, said respective connecting sections having corresponding substantially circular cross-sections;

wherein the parabolic region (3) has at least one part with a substantially rectangular cross-section and the at least one part is located between said respective connecting sections to the funnel neck and the funnel body.

2. The glass funnel as defined in claim 1, wherein the substantially rectangular cross-section in the at least one part of the parabolic region has a side ratio substantially corresponding to a side ratio of the substantially rectangular cross-sections of the funnel body.

3. The glass funnel as defined in claim 1 or 2, wherein the parabolic region has transverse cross-sections that are continuously increasing in area passing in a direction from the funnel neck to the funnel body.

4. The glass funnel as defined in claim 1, wherein the parabolic region has transverse cross-sections with diagonals and said diagonals are continuously increasing moving in a direction from the funnel neck to the funnel body.

* * * * *